United States Patent [19]

Morianz

[11] 4,335,779

[45] * Jun. 22, 1982

[54] DEVICE FOR CONTINUOUS HORIZONTAL CASTING

[75] Inventor: Josef V. Morianz, Illnau, Switzerland

[73] Assignee: Swiss Aluminium Ltd., Chippis, Switzerland

[ * ] Notice: The portion of the term of this patent subsequent to Jul. 8, 1997, has been disclaimed.

[21] Appl. No.: 109,826

[22] Filed: Jan. 7, 1980

Related U.S. Application Data

[63] Continuation-in-part of Ser. No. 971,005, Dec. 19, 1978, Pat. No. 4,211,275.

[51] Int. Cl.[3] ..... B22D 11/00

[52] U.S. Cl. ..... 164/440; 164/490

[58] Field of Search ..... 164/82, 440, 439; 222/591

[56] References Cited

U.S. PATENT DOCUMENTS 4,211,275 7/1980 Morianz ..... 164/440

*Primary Examiner*—Robert D. Baldwin
*Assistant Examiner*—K. Y. Lin
*Attorney, Agent, or Firm*—Bachman and LaPointe

[57] ABSTRACT

In a device for the horizontal continuous casting of ingots or billets without pronounced structure there is provided in the wall of the trough an opening which connects up with another opening in the lower part of a disc-shaped nozzle which is used to transfer the molten metal to the mold. For casting rectangular ingots this nozzle opening is in plan view approximately in the form of a dog bone shaped slit, and is provided with a run-out surface inclined in the direction of casting and running into the inner face of the mold. The opening forms a trumpet-shaped taper towards the inside of the trough.

10 Claims, 10 Drawing Figures

DEVICE FOR CONTINUOUS HORIZONTAL CASTING

CROSS REFERENCE TO RELATED APPLICATION

This application is a continuation-in-part of application Ser. No. 971,005, filed Dec. 19, 1978, now U.S. Pat. No. 4,211,275.

BACKGROUND OF THE INVENTION

The present invention resides in a device for continuous, horizontal casting of metals, particularly aluminum and its alloys, using a casting trough, a holding furnace or the like having in one wall near the bottom a tapping hole which connects up to a nozzle opening situated in the lower part of a disc-shaped nozzle by means of which the molten metal is transferred to the mold.

The components used for the melt transfer system in horizontal casting are generally made of refractory materials in some versions in combination with nozzles made of graphite or another suitable material, or of insulated or plasma coated metal. The outlet for the melt is situated near the floor of the holding furnace or casting trough and connects up with the opening in the lower part of the nozzle; the exceptions here are systems for casting special shapes, for example U shaped rails, tubes, box-shaped sections, and the central pouring system with built-in baffle plates.

When casting round ingots, there is a channel-shaped part with refractory lining connected up to the nozzle which is in the form of a disc with a circular opening in it. The metal leaves the trough via that nozzle on its way to the mold, the nozzle opening forming an abrupt transition, as a result of its position with respect to the inner face of the mold. Such systems can be employed only for certain products which have to meet normal quality standards since there are frequently surface flaws such as, for example, differences in the quality of the upper and lower surfaces of the ingot, open or concealed shuts, in particular in the upper region, laps, bleeding, roughness and surface segregation. Inside the ingot there can be clusters of particles, a so-called marble structure, internal cracks and dross. One can also find coring, an inhomogeneous structure in the form of onion-like solidification rings, an inhomogeneous sump with striations, and a tendency for twinned or feathery crystals to form. It is therefore impossible to guarantee uniform quality.

In U.S. Pat. No. 3,381,741 a simple arc-shaped slit is disclosed as a nozzle-like opening in the wall of a casting trough, which however also suffers from the above mentioned and further disadvantages.

SUMMARY OF THE INVENTION

With this in mind the inventor set himself the task of improving a device of the kind mentioned hereinabove avoiding the known shortcomings and, in particular, making it possible to produce by continuous horizontal casting defect-free ingots without pronounced structure and with completely satisfactory surface quality.

This object is achieved by way of the present invention in that the opening in the nozzle when casting substantially rectangular billets, as viewed in end view, is approximately dog bone shaped such that the widest part of the nozzle opening is at or near the extreme ends of the opening, a suitable run-out surface with a shape in the direction of casting which surface runs stepless into the inner face of the casting mold.

By way of comparison with the methods of horizontal continuous casting known up to now, where, as a result of the geometry of the metal feed system, there is an artificial meniscus, and therefore changes in the casting parameters, e.g. higher casting rate or temperature which normally eliminate cold shuts in vertical DC casting, do not help, the transfer of metal from the nozzle to the mold is improved and carried out smoothly by means of the device of the present invention viz, the diffusive-like design of the nozzle slit or opening providing the run-out surface, and the direct connection of the inner face of the mold to the run-out surface at the same time avoiding the formation of a meniscus.

According to another feature of the present invention the favorable range for the angle of the nozzle run-out surface lies between 0° and 45°, preferably between 10° and 35°, whereby the lower limit of 0° comes into consideration only for the beginning and the end part of the run-out surface, and the upper limiting value of 45° and the preferred limits of 10° and 35° refer to the average inclination over the whole length of the run-out surface.

It has been found favorable to hollow out the face of the nozzle body facing the mold and this in fact over such a width that the free edge of the wall of the hollow space comes to lie in line with the edge of the inner face of the mold. This face of the hollow space which serves to guide or lead the molten metal flowing to the mold is usefully conical in shape and is at an angle of at most 45°, preferably 10° to 35° to the long axis of the casting device and therefore to the inner wall of the mold. Usefully this conical surface is connected up to the base of the hollow space via a curve e.g. circular shaped section. This last mentioned surface can be flat or curved concave and forms the actual end face of the nozzle body. It is also possible to make the whole of the wall surface of the hollow space one curve. The tangent to this surface in the immediate vicinity of the mold should then be at an angle of 0°–45°, preferably 10°–35°. In general the value 0° applies at most to the last millimeters of the wall of the hollow space, near the mold. The space, or chamber, described here functions as a hot melt reservoir before the entrance to the mold. As a result of this special design of the wall of the hollow space which acts as metal guiding or leading surface, which connects up smoothly, without any steps, to the inner wall of the mold, raising of the molten metal and therefore the formation of an artificial meniscus is prevented all around. As a result of these two measures, cold shuts are avoided, also in case of alloys which are difficult to cast, and there is a considerable reduction in the incidence of surface flaws; the result is a uniform, smooth ingot surface, free of cold shuts, surface tears, oxide inclusions and oxide skin. By the provision of the dog bone shape of the nozzle slit which is suitable for casting rectangular ingots or the like, a purposeful locally different feed of metal is achieved, viz, in the region of the plane of corners of the ingot, where, at the top and the bottom, the surface and structural flaws occur most, more metal and therefore more heat being supplied there than in the center.

Within the thickness of the nozzle body, as was already mentioned, the run-out surface of the nozzle opening is inclined in the direction of casting; with the provision of the above mentioned space, its wall surface, or leading surface, usefully forms the outer part of the run-out surface. Advantageously, the run-out surface forms an elongated S-curve as viewed in longitudinal section. Over the rest of the periphery of the slit its wall changes over, via a curved part, into the outlet end face of the nozzle body. Even if no cold shuts are to be feared at this place removed from the cold mold, these curves produce a quiet laminar flow without any of the troublesome turbulence which would lead to flaws in the upper part of the ingot.

The described, selected dog bone shape of the nozzle slit with the inclined run-out surface prevents, in particular, the formation of clusters of particles and the formation of regions of variable structure in the ingot, such as can be observed in conventionally cast ingots.

The favorable effect of the dog bone shaped nozzle slit with inclined run-out surface connected to the hollow space of the nozzle front end can be increased by means of a further development of the invention in that the opening in the trough has a trumpet-shaped taper towards its inside, as viewed in cross section, the lower contour of the opening, as viewed in longitudinal section, thereby forming a saddle above the level of the trough floor.

In another preferred embodiment of the invention, the upper longitudinal contour of the trumpet-shaped, tapering inlet is approximately in the form of one half of a catenary curve.

Usefully the opening with the trumpet-shaped inlet taper is situated in a special, separable part of the trough which can be changed any time without difficulty, in particular when an opening of a different size is required. It has also been found favorable for handling purposes to make the component containing the opening out of a refractory material and to construct it together with the nozzle, if desired also with the mold, as a single unit.

BRIEF DESCRIPTION OF THE DRAWINGS

Further advantages and features of the present invention are revealed in the following description of preferred exemplified embodiments and with the help of the drawings in which.

DETAILED DESCRIPTION

Figure 1:
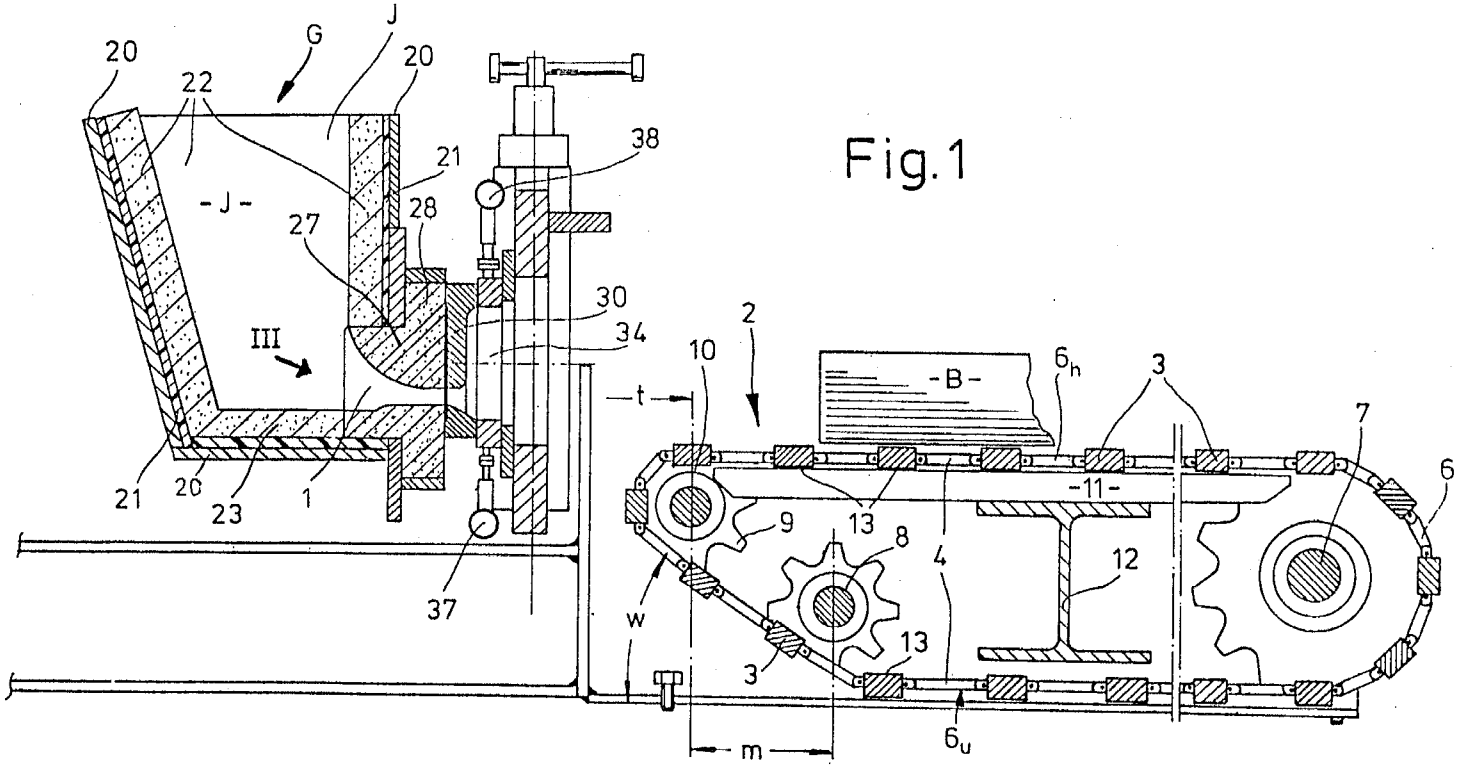
FIG. 1 is a partly sectioned longitudinal view of equipment for horizontal continuous casting.

An equipment for horizontal continuous casting of ingots or billets B with little structure has a casting trough G and a belt-like transfer table 2 in line downstream from the outlet or outlets 1 of the trough comprising substrate bars 3 which lie transverse to the direction of casting t and are moved in the casting direction t by the links 4 of a pair of chains 6. The drive 7 for the chains 6 is positioned at the end of the casting belt 2 away from the trough; towards the outlet 1 the lower part $6_u$ of the chain belt is raised and in fact raised at an angle w of about 30° between two guiding sprocket-wheels 8, 9 over a distance m—measured on a horizontal projection. After passing over the zenith 10 of the upper guide sprocket-wheel 9 the substrate sections 3 which are then pulled along by the upper part $6_h$ of the chain on a plurality of rails 11 which lie in the casting direction t and in turn are supported by I-beams 12. The latter are provided with a layer 13 to allow easy sliding and therefore to prevent friction between the rails 11 and the substrate sections 3.

The walls 20 of the trough G are provided with a layer 22 of refractory material, with insulation 21 between the walls 20 and refractory lining 22; likewise the floor 23 of the trough is made of a refractory layer over the surface 24 of which the melt, not shown in the drawing, flows into the outlet opening or openings 1.

The opening 1 of length n in the trough G is situated in a unit 27 made out of refractory material, the outer part 28 of which is situated between steel ribbing 29. Connecting up to this outer part 28 is a disc-shaped nozzle 30, the opening 31 in which is below the center Z, as specified by the nozzle axis M, and together with the opening 1 of length n creates a pouring channel 32 of total length q.

Between the nozzle 30 and the neighboring part 28 of the insert 27 there is a heat resistant seal 33. Downstream of the nozzle 30 there is a mold 34 which is connected to the nozzle 30 by means of bolts. In FIG. 1 the connections for oil and water supply to the mold 34 are indicated by the numerals 37 and 38.

The diameter d of the mold recess also determines the breadth e of a dummy block 40 which has a conical part 41 pointing counter to the direction of casting and which is moved into the mold recess before the start of the casting operation; the metal ingot which forms is drawn out of the mold 34 with this dummy block 40.

Figure 3:
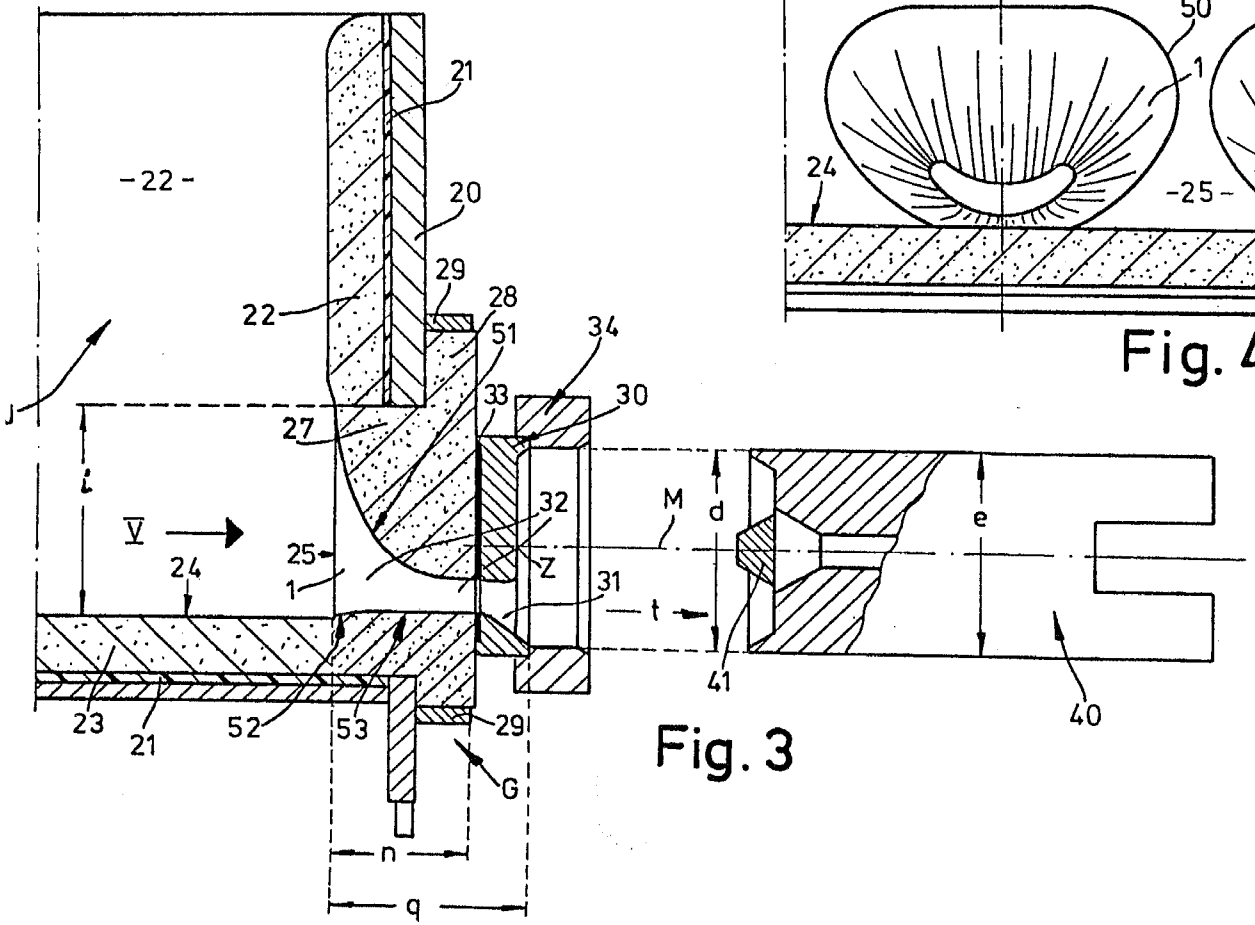
FIG. 3 is a detail of a further exemplified embodiment, enlarged over the scale used in FIG. 1.
Figure 6:
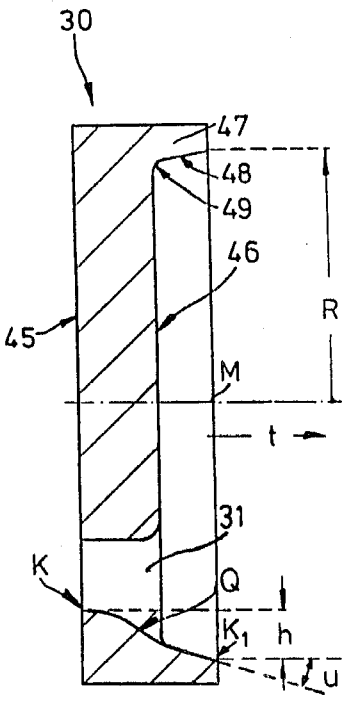
FIG. 6 is a cross section through FIG. 5 along the line VII—VII.
Figure 5:
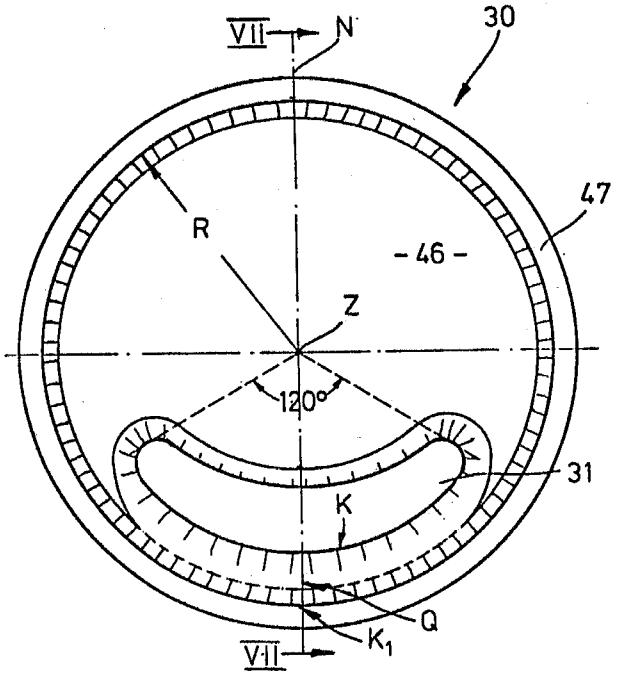
FIG. 5 is an enlarged end view of a nozzle with slit-shaped opening.

As shown in FIGS. 5 and 6, the inlet side 45 to the nozzle 30 facing the trough G is in the form of a smooth uninterrupted surface; the outlet side 46 facing the direction of casting t on the other hand has a ring-shaped edge 47. This edge forms the hollow space or chamber which acts as a warm melt reservoir before the entrance to the mold. The wall of the ring-shaped part 47 facing this hollow space forms the so-called wall surface of the hollow space, or leading surface, which features here a conical region 48 which changes over to a curve 49 in the flat run-out surface 46. The mold 34 lies against the end face of the ring-shaped part 47 in such a way that its inner face connects to the wall 48 of the hollow space, as shown in FIG. 3.

In the end view shown in FIG. 5 the nozzle opening 31 when casting substantially round billets is a curved, banana- or mouth-shaped slit near the lower edge of the nozzle 30, as viewed when installed. The lower edge K of the opening 31 in the inlet side 45 facing the trough is vertically a height h higher than the sharp edge $K_1$ at the ring-shaped part 47 of the nozzle 30. The inclination u of the run-out surface Q is approximately 15° in FIG. 6; in other exemplified embodiments it is 15° to 30°; advantageously it should not be less than 10°.

Figure 7:
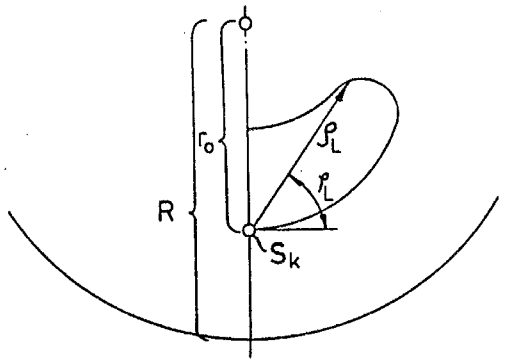
FIG. 7 is a sketch of part of a polar coordinate system for calculating the closed curve shown in FIG. 8.

In the case of a nozzle or mold radius R (in centimeters) the lowest point $S_k$ of the nozzle opening, on the inlet side 45 of the nozzle, is at a distance $r_o$ below the center Z of the nozzle (see FIG. 7), whereby $r_o$ is from 0.5.R to 0.9.R, preferably from 0.65.R to 0.8.R. The geometry of the slit 31 on both sides of the nozzle 30 can be described by a Fourier series, in polar coordinates (radius vector $\rho$, angle $\phi$) with center $S_k$ (FIG. 7).

In this Fourier series the relation $$\phi_L = \frac{\pi \cdot L}{N}$$

is used, where N is the total number of measurements and N was chosen to be 30 i.e. measurements were made at 6° intervals, L is the number of measurement: L=0, 1, . . . N-1, and $\phi_L$ is the angle corresponding to the measurement in question.

The radius vector $\rho_L$ for each measurement is then obtained from the following approximation formula:

$$\rho_L = \frac{R}{9} \cdot \sum_{K=0}^{3} A(K) \cdot \cos(K \cdot 2\,\phi_L) \qquad \text{(equation I)}$$

in centimeters.

The coefficients for an opening of maximum, minimum and preferred size were worked out both for the inlet and the outlet sides of the nozzle. These are presented in the following table:

TABLE

| A (K) | minimum size | maximum size | Preferred sizes 1 | Preferred sizes 2 |
|---|---|---|---|---|
| Inlet side | | | | |
| A (0) | +3,160 | +6,050 | +3,793 | +4,116 |
| A (1) | +0,677 | −1,064 | −0,189 | +0,310 |
| A (2) | −1,241 | −3,644 | −1,942 | −1,745 |
| A (3) | −1,387 | −0,719 | −1,059 | −1,272 |
| Outlet side | | | | |
| A (0) | +5,303 | +7,308 | +6,045 | |
| A (1) | −0,764 | −1,534 | −0,981 | |
| A (2) | −2,204 | −4,002 | −2,621 | |
| A (3) | −0,624 | −0,344 | −0,846 | |

Figure 8:
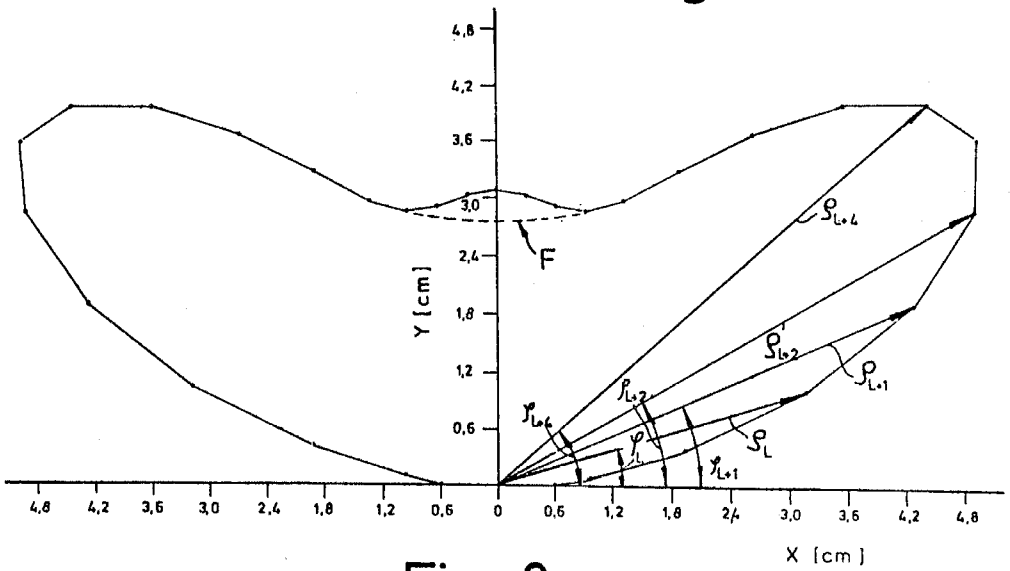
FIG. 8 is an enlarged contour of the nozzle opening, enlarged over the scale in FIG. 5.

By using equation I a banana-shaped design is obtained for the various openings, as shown in FIG. 8. The approximation of the Fourier equation leads however to an irregular shape in the middle of the upper part of the curve which is to be corrected by the contour F, as shown in FIG. 8. Between the maximum and minimum sizes there are average sizes which are similar in shape and come into question as the contours for the inlet and outlet sides of the nozzle opening 31. The values of A(K) mentioned in the table hereabove are valid for a diameter of the nozzle or of the mold of 9 cm. However the factor R/9 in equation I gives the correction for all other values of R automatically.

As seen from the center Z of the nozzle, the opening sizes so obtained for the inlet side of the nozzle extend within an angle of about 90° to 180°, preferably of above 120°±15°.

In particular, it is possible to design the nozzle opening, as shown in FIG. 5. On the inlet side of the nozzle the opening 31 is delimited:—below by an arc-shaped curve (K) the center of which coincides approximately with the center of the nozzle,—above by an arc-shaped curve of a larger radius and having its center above the center Z of the nozzle,—and at the side by two arcs of smaller diameter. This results in the banana-shaped opening which narrows towards its ends. In this nozzle, shown in FIG. 5, the opening size on the inlet side of the nozzle extends within an angle of 120°, as seen from the center Z of the nozzle.

In this version the lower curve or edge K runs parallel to the contour of the conical surface 48 with the edge $K_1$. Between the curves, or edges, K and $K_1$ there is the run-out surface Q which is in the form of an elongated S-curve as shown in longitudinal section in FIG. 6.

The difference in height h between the edges K and $K_1$, as shown in FIG. 6, is 10–35 mm, preferably 16–25 mm, in nozzles having a total thickness (including the edge 47) of about 50 mm. For thicker or thinner nozzle bodies these limits of h may vary proportionally.

Figure 9:
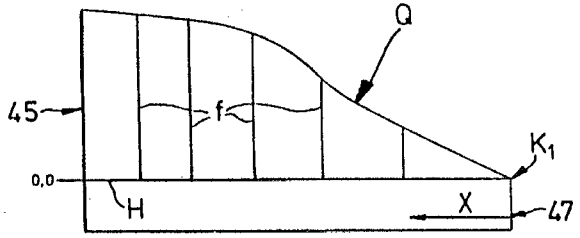
FIG. 9 is a schematic, enlarged longitudinal section through a part of the nozzle.

A particularly favorable longitudinal contour for the run-out surface of the nozzle slit 31 at its lowest point is obtained from the equation expressed in cartesian coordinates:

$$f = \sum_{K=0}^{4} B_K \cdot X^K \qquad \text{(equation II)}$$

where f is the relevant vertical distance between a point on the contour and a horizontal H shown in FIG. 9, and X is the relevant horizontal distance to the end face of the edge 47.

If f and X are expressed in centimeters, the following values hold for the coefficients $B_K$:

$B_0 = +0{,}0588$
$B_1 = -0{,}0454$
$B_2 = +0{,}6459$
$B_3 = -0{,}1744$
$B_4 = +0{,}01325$

These values for B lead, for a nozzle plate of total thickness of 48 mm, to a vertical difference h of 24.6 mm between the edges $K_1$ and K. A flatter or steeper run-out surface within the usable h-values of 15 to 35 mm is achieved, if the relevant f-values of one of each curve is reduced or increased by up to 40%. On both sides of the vertical symmetry plane the run-out surface, as viewed in longitudinal section, exhibits a similar or approximately similar path.

Figure 2:
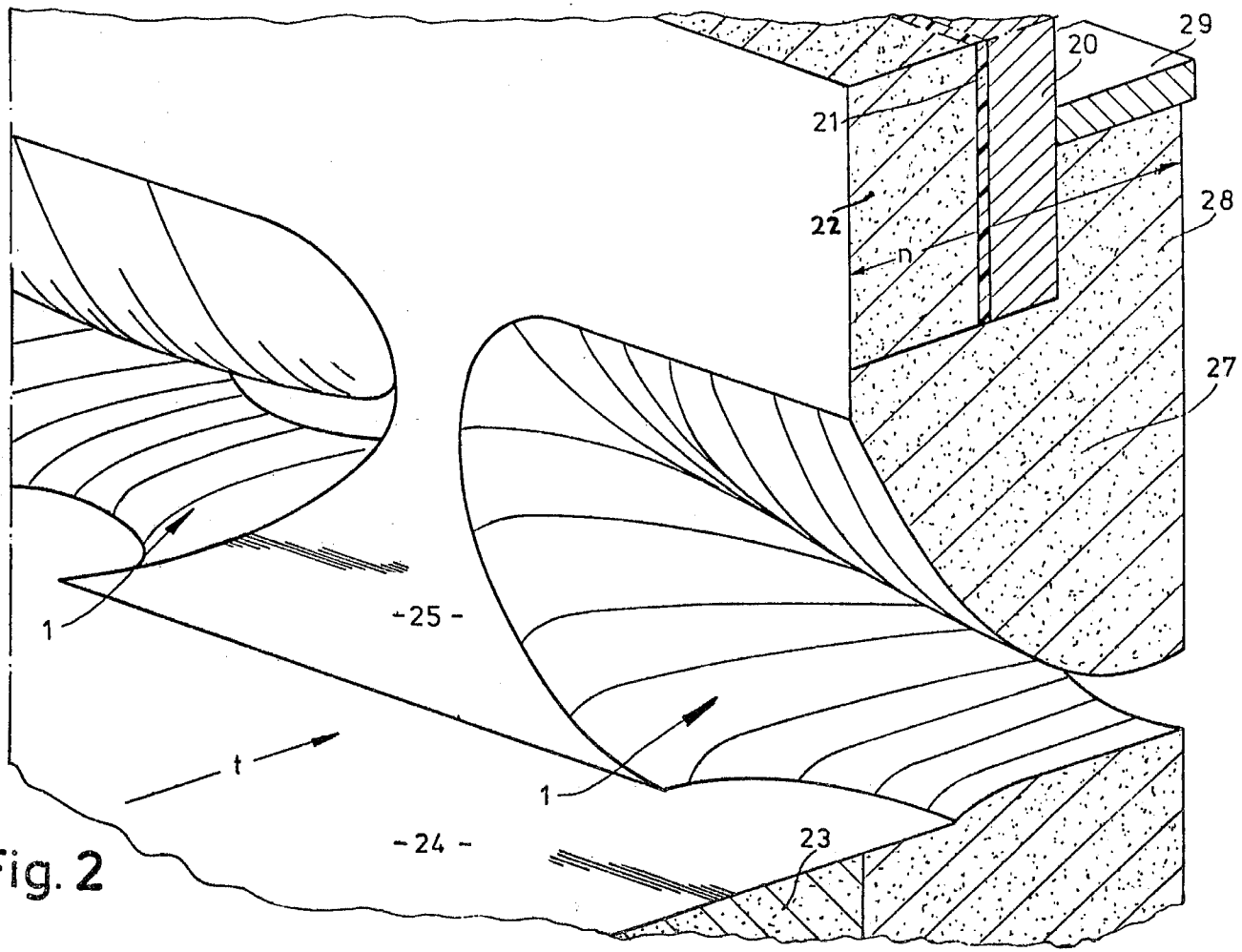
FIG. 2 is an enlarged perspective view of part of FIG. 1, as viewed in the direction of the arrow III in FIG. 1.
Figure 4:
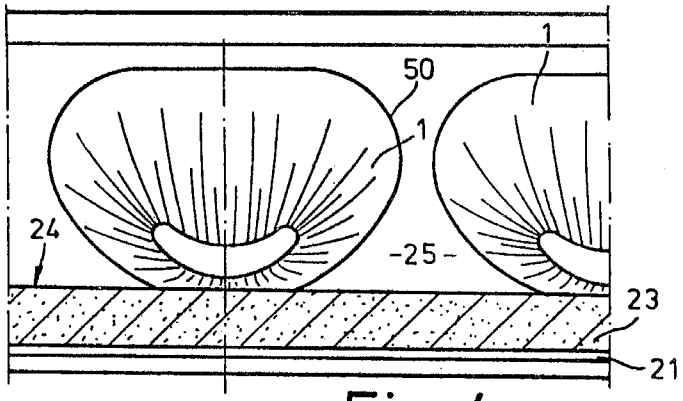
FIG. 4 is an end view of a part of FIG. 3, as viewed in the direction of the arrow V.

The overall shape of the opening 1 and the nozzle slit 31 can be seen from FIGS. 2 and 3:

On the inside 25 of the trough there is an almost oval funnel edge 50 of a height i above the floor 24 of the trough corresponding approximately to the length n of the opening 1. The opening 1 narrows symmetrically with respect to a vertical plane from this funnel edge 50.

The longitudinal section as in FIG. 3 shows the upper edge 51 of the opening 1 in the unit 27, approximately in the form of a catenary curve which runs relatively flat in the outer part 28 of the unit 27 and in the most part of the nozzle 30.

The lower face of the opening 1, 32, beginning from the trough end, rises at a gentle slope 52 to then form an approximately horizontal part 53, and then inside the nozzle 30 falls steeply by an amount h as a run-out surface. This produces together with the incurvature in cross section a saddle shape for the said lower face.

Due to the shape of the nozzle opening 31, when casting substantially round billets the hot stream of the molten metal is directed obliquely onto the lower part of the inner face of the mold, with the result that:

the coarse clusters of floating crystals which sink under the force of gravity to the lower part of the sump are redissolved or made smaller by remelting, and therefore the region of the pasty zone is made narrower, the natural thermal convection is to a large extent compensated in that the lower part of the sump is fed by the hot melt stream and the upper part of the sump lies away from the stream, this resulting in a large equalization of temperature within the sump.

In the region where the effect is mainly desired, the pouring slit 31 presents also its greater width and allows the passage of more hot melt and therefore of more heat. In this way, the formation of clusters or agglomeration of particles as well as of a "marble" structure can be avoided. The laminar flow is maintained everywhere; there is neither turbulence nor dead spaces or corners. The sump geometry is symmetrical and the cross section of the billet or ingot B consequently has a completely homogeneous structure.

The trumpet shape of the unit 27 in the trough G results in an optimum flow of metal towards the nozzle and to a further diminution of the "marble" structure caused by dead zones and turbulence; there is only laminar acceleration up to the nozzle 30.

Furthermore, due to this trumpet shape, stationary metal (cold melt) is avoided in the trough G, which cold melt, if appearing and allowed to flow into the sump, would cause so-called pre-solidification and produce clusters.

Smooth, uniform, defect-free ingot surfaces are obtained by means of a relatively simple shape of nozzle 30 which can be produced at no extra expense and requiring only little time for fitting into place.

Figure 10:
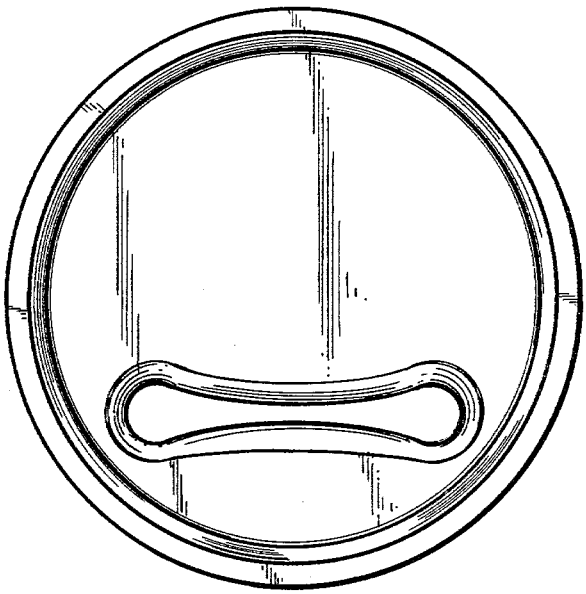
FIG. 10 is an enlarged end view of a nozzle with the dog bone shaped opening.

The melt feed system described above is particularly suitable for casting round ingots or the like. This melt feed system can however also be used for casting rectangular rolling ingots and other sections. However, when casting rectangular shapes it appears that particular regions of the ingot cross section, particularly near the edges, require more heat, that is a larger hot melt feeding than other regions. Accordingly the nozzle slit should be a dog bone shape as illustrated in FIG. 10 so as to dispose the wider part of the pouring slit not in the middle of the slit as required for round ingots or the like, but in the side parts or ends of the slit. The run-out surface should also be formed in order to direct more metal to the exposed regions. Besides the foregoing all prescriptions relating to the spacing or chamber and its leading surface on the end face 46 of the nozzle as well as to the position of the mold with respect to the nozzle remain the same when casting substantially rectangular billets as when casting round billets. It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved apparatus for use in the continuous horizontal casting of molten metal comprising, in combination, a molten metal holding means having a floor and an outlet; a mold in line with said holding means and nozzle means disposed between said holding means outlet and said mold the improvement comprising:

said nozzle means comprising a plate having a first surface facing said holding means and a second surface facing said mold, said plate being provided with an elongated opening lying in a plane substantially perpendicular to the flow of said molten metal and communicating said holding means outlet with said mold, wherein said elongated opening varies in size along substantially the entire length with the greatest cross section at the end points and substantially symmetrically tapering toward the middle so as to provide for preferential metal flow to said mold, said opening having a lower surface provided at least in part with a downwardly sloping run-out surface extending from said first surface of said plate to said second surface of said plate.

2. An apparatus according to claim 1 wherein said holding means outlet is substantially in the form of a trumpet-shaped taper tapering toward said mold, the bottom wall of said outlet being substantially parallel to and above said floor of said holding means.

3. An apparatus according to claim 1 wherein the nozzle opening is symmetric to the vertical plane of symmetry of said plate.

4. An apparatus according to claim 1 wherein the nozzle opening is funnel shaped in form which diverges toward the mold in the direction of casting.

5. An apparatus according to claim 1 wherein the run-out surface of the nozzle opening presents in longitudinal cross section the form of an elongated S-curve.

6. An apparatus according to claim 2 wherein the upper contour of said outlet, as viewed in section through its middle, is approximately half of a catenary curve in appearance.

7. An apparatus according to claim 2 wherein said holding means outlet is a special insertable part of the molten metal holding means.

8. An apparatus according to claim 2 wherein the wall part penetrated by the outlet is made of refractory material and is combined with the nozzle means to make a built-in unit.

9. An apparatus according to claim 1 wherein a ring-shaped edge is provided on the circumference of said second surface of said plate, said ring-shaped edge projects toward said mold and defines a chamber before the mold entrance.

10. An apparatus according to claim 9 wherein the run-out surface of the nozzle opening runs smoothly onto the lower surface of the ring-shaped edge.

* * * * *